US010026533B2

(12) United States Patent
Takajo et al.

(10) Patent No.: US 10,026,533 B2
(45) Date of Patent: Jul. 17, 2018

(54) GRAIN-ORIENTED ELECTRICAL STEEL SHEET FOR IRON CORE AND METHOD OF MANUFACTURING THE SAME

(71) Applicant: JFE STEEL CORPORATION, Tokyo (JP)

(72) Inventors: Shigehiro Takajo, Kurashiki (JP); Hiroi Yamaguchi, Kurashiki (JP); Seiji Okabe, Kurashiki (JP); Kazuhiro Hanazawa, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 576 days.

(21) Appl. No.: 14/415,979

(22) PCT Filed: Aug. 29, 2013

(86) PCT No.: PCT/JP2013/005124
§ 371 (c)(1),
(2) Date: Jan. 20, 2015

(87) PCT Pub. No.: WO2014/034128
PCT Pub. Date: Mar. 6, 2014

(65) Prior Publication Data

US 2015/0187474 A1 Jul. 2, 2015

(30) Foreign Application Priority Data

Aug. 30, 2012 (JP) ..... 2012-190534

(51) Int. Cl.
*C22C 38/02* (2006.01)
*C22C 38/06* (2006.01)
(Continued)

(52) U.S. Cl.
CPC ..... *H01F 1/14775* (2013.01); *C21D 1/34* (2013.01); *C21D 6/001* (2013.01); *C21D 6/002* (2013.01);
(Continued)

(58) Field of Classification Search
CPC ..... C22C 38/60; C22C 38/44; C22C 38/42
See application file for complete search history.

(56) References Cited

U.S. PATENT DOCUMENTS 5,296,051 A 3/1994 Inokuti et al.
2009/0272464 A1 11/2009 Hamamura et al.

FOREIGN PATENT DOCUMENTS

CN 101528951 A 9/2009
CN 102031342 A 4/2011
(Continued)

OTHER PUBLICATIONS

Apr. 25, 2016 Office Action issued in Korean Patent Application No. 10-2015-7005014.
(Continued)

*Primary Examiner* — Deborah Yee
(74) *Attorney, Agent, or Firm* — Oliff PLC

(57) ABSTRACT

According to the present invention, a grain-oriented electrical steel sheet for iron cores exhibiting excellent transformer iron loss properties in an excitation range from 1.5 T to 1.9 T is provided, in which a residual stress of 150 MPa or more is formed near strain regions, each extending 300 μm or less in the rolling direction and 42 μm or more in the sheet thickness direction, and the strain regions are formed periodically at intervals of 2 mm to 10 mm in the rolling direction, with reduced energy loss in transformers in operation.

16 Claims, 4 Drawing Sheets

(51) Int. Cl.

| | |
|---|---|
| ***C21D 8/12*** | (2006.01) |
| ***C21D 9/46*** | (2006.01) |
| ***H01F 1/16*** | (2006.01) |
| ***H01F 1/147*** | (2006.01) |
| ***C21D 1/34*** | (2006.01) |
| ***C21D 6/00*** | (2006.01) |
| ***C22C 38/00*** | (2006.01) |
| *C22C 38/60* | (2006.01) |
| *C22C 38/04* | (2006.01) |
| *C22C 38/08* | (2006.01) |
| *C22C 38/12* | (2006.01) |
| *C22C 38/16* | (2006.01) |
| *C22C 38/18* | (2006.01) |
| *C22C 38/20* | (2006.01) |
| *C22C 38/22* | (2006.01) |
| *C22C 38/34* | (2006.01) |
| *C22C 38/42* | (2006.01) |
| *C22C 38/44* | (2006.01) |

(52) U.S. Cl.

CPC ..... *C21D 6/004* (2013.01); *C21D 6/005* (2013.01); *C21D 6/008* (2013.01); *C21D 8/1244* (2013.01); *C21D 8/1294* (2013.01); *C21D 9/46* (2013.01); *C22C 38/00* (2013.01); *H01F 1/16* (2013.01); *C21D 8/1283* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/18* (2013.01); *C22C 38/20* (2013.01); *C22C 38/22* (2013.01); *C22C 38/34* (2013.01); *C22C 38/42* (2013.01); *C22C 38/44* (2013.01); *C22C 38/60* (2013.01)

(56) References Cited

FOREIGN PATENT DOCUMENTS

| | | | |
|---|---|---|---|
| EP | 1 227 163 | A2 | 7/2002 |
| EP | 2 602 339 | A1 | 6/2013 |
| JP | H04362139 | A | 12/1992 |
| JP | H05179355 | A | 7/1993 |
| JP | H05335128 | A | 12/1993 |
| JP | H062042 | A | 1/1994 |
| JP | H0622179 | B2 | 3/1994 |
| JP | H11279645 | A | 10/1999 |
| JP | 2003027196 | A | 1/2003 |
| JP | 2005248291 | A | 9/2005 |
| JP | 2007002334 | A | 1/2007 |
| JP | 2008106288 | A | 5/2008 |
| JP | 2008127632 | A | 6/2008 |
| JP | 2011246782 | A | 12/2011 |
| JP | 2012001741 | A | 1/2012 |
| JP | 2012036445 | A | 2/2012 |
| JP | 2012036450 | A | 2/2012 |
| JP | 2012052230 | A | 3/2012 |
| JP | 2012-135123 | A | 7/2012 |

OTHER PUBLICATIONS

May 26, 2016 Office Action issued in Chinese Patent Application No. 201380044990.2.

Feb. 3, 2016 Office Action issued in Chinese Patent Application No. 201380044990.2.

Nov. 26, 2013 Search Report issued in International Application No. PCT/JP2013/005124.

Sato, Keiji et al. "Heat-Proof Domain-Refined Grain-Oriented Electrical Steel". Kawasaki Steel Technical Report. vol. 29, 153-158, 1997.

Dec. 1, 2016 Office Action issued in European Patent Application No. 13 834 271.2.

Jun. 2, 2015 Office Action issued in Japanese Patent Application No. 2014-532802.

Oct. 23, 2015 Extended Search Report issued in European Patent Application No. 13834271.2.

GRAIN-ORIENTED ELECTRICAL STEEL SHEET FOR IRON CORE AND METHOD OF MANUFACTURING THE SAME

TECHNICAL FIELD

The present invention relates to a grain-oriented electrical steel sheet (also called a grain-oriented magnetic steel sheet) for iron cores of transformers, and to methods of manufacturing the same.

BACKGROUND ART

In recent years, energy use has become more and more efficient, and demands are increasingly being made for reducing energy loss in transformers in operation. There are mainly two types of loss that may arise in transformers: one is copper loss in conductors and the other is iron loss in iron cores. Iron loss can be further divided into hysteresis loss and eddy current loss. Improving crystal orientations in the material and reducing impurities therein are known to be effective for reducing hysteresis loss.

For example, JP20121741A (PTL 1) describes a method for manufacturing a grain-oriented electrical steel sheet that shows excellent magnetic flux density and iron loss properties by optimizing the conditions of annealing prior to final cold rolling.

On the other hand, eddy current loss is known to drastically improve by reducing the sheet thickness, increasing the a mount of Si added, forming grooves on a surface of the steel sheet, and introducing strains.

For example, JPH0622179B (PTL 2) describes a technique to form linear grooves on one surface of a steel sheet with the groove width of 300 μm or less and the groove depth of 100 μm or less, whereby iron loss $W_{17/50}$ can be reduced from at least 0.80 W/kg prior to the formation of grooves to 0.70 W/kg or less.

In addition, JP2011246782A (PTL 3) describes a technique whereby a steel sheet after being subjected to secondary recrystallization is subjected to plasma arc irradiation to reduce iron loss $W_{17/50}$ from at least 0.80 W/kg prior to the irradiation to 0.65 W/kg or less.

Further, JP201252230A (PTL 4) describes a technique to obtain a material for transform ers that exhibits low iron loss properties and produces less noise by optimizing the film thickness and the average width of the magnetic domain discontinuous portions formed by electron beam irradiation on a surface of a steel sheet.

CITATION LIST

Patent Literature

PTL 1: JP20121741A
PTL 2: JPH0622179B
PTL 3: JP2011246782A
PTL 4: JP201252230A
PTL 5: JP200327196A
PTL 6: JP20072334A
PTL 7: JP2005248291A
PTL 8: JP2008106288A
PTL 9: JP2008127632A

Non-Patent Literature

NPL 1: *Kawasaki Steel Technical Report No.* 29 (1997) 3, pp. 153-158

SUMMARY OF INVENTION

Technical Problem

The low iron loss material having grooves formed therein as disclosed in PTL 2 has an advantage over a material, which has been subjected to magnetic refinement by applying thermal strain thereto by means of plasma arc, laser and the like, in the sense that the magnetic domain refining effect persists in a steel sheet, even after being subjected to annealing for removing strain during the process to produce a winding-type transformer. Such magnetic domain refining by groove formation is, however, relatively less effective for reducing iron loss, and has the problem of low magnetic flux density since the volume of the steel substrate decreases due to groove formation.

Here, applying thermal strain to steel is indeed effective for obtaining a material capable of providing stacked transformers with ultimately low iron loss. Any of the conventional methods as disclosed in PTL 3 and PTL 4 have only assessed the property of $W_{17/50}$.

Transformers using grain-oriented electrical steel sheets are not always used for excitation at 1.7 T, yet small transformers are often used at a magnetic flux density of around 1.5 T and larger transformers at a magnetic flux density over 1.8 T.

Thus, from the viewpoint of more freedom in design for transformer manufactures, it is preferred that grain-oriented electrical steel sheets used for iron cores of transformers and the like have low iron loss over a magnetic flux density range of, approximately, 1.5 T to 1.9 T.

FIG. 1 shows the influence of excitation magnetic flux density on transformer iron loss in different samples. As shown, it can be seen that sample A and sample B exhibit comparable iron loss when excited at 1.7 T, while showing obvious differences in iron loss when excited at 1.5 T and at 1.9 T, respectively. Accordingly, it is revealed that a steel sheet, which exhibits a good iron loss property when excited at 1.7 T, does not necessarily exhibit a good iron loss property in other excitation conditions.

Techniques to reduce iron loss in such a magnetic flux density range other than 1.7 T are disclosed in, for example, JP200327196A (PTL 5) and JP20072334A (PTL 6). The former discloses, as a method for producing a material without using a magnetic domain refining process, a technique to controlling the ratio of $W_{19/50}$ to $W_{17/50}$ to be 1.6 or less by changing heating rate and atmosphere during decarburization annealing. This technique, however, has some restrictions on steel composition, such as the need to add Bi, resulting in increased costs of a slab for a material accordingly, and furthermore, unstable secondary recrystallization in steel, and so on.

On the other hand, the latter discloses a technique to reduce iron loss at an excitation magnetic flux density of 1.9 T by optimizing the conditions for irradiating a steel sheet with laser. This technique, however, is intended to be applied to an iron core to be subjected to stress relief annealing, and consequently, depressions are formed on a surface of a steel sheet as is the case with the groove formation technique disclosed in PTL 2. The technique has the problem of lower magnetic flux density of the resulting material.

The present invention was made in view of the aforementioned current situation, and an object thereof is to provide a grain-oriented electrical steel sheet for iron cores that has excellent transformer iron loss properties in the excitation range of 1.5 T to 1.9 T and thus exhibits reduced energy loss in the resulting transformer in operation, and a method for manufacturing the same in an advantageous manner.

Solution to Problem

The inventors of the present invention, as a result of intensive study to solve the aforementioned problem, discovered that by optimizing stress distribution in steel, extremely low it on loss can be obtained in the entire excitation magnetic flux density range of 1.5 T or more.

The conventional art, for example, JP2005248291A (PTL 7) and JP2008106288A (PTL 8) each disclose a technique to reduce iron loss by optimizing stress distribution after laser irradiation.

It is noted here that PTL 7 describes that the maximum tensile stress applied to a surface of a steel sheet in rolling direction can be set in the range of 70 MPa to 150 MPa to thereby reduce eddy current loss in steel and reduce iron loss.

In addition, PTL 8 describes that it is possible to reduce iron loss of a steel sheet by controlling the compressive residual stress in rolling direction to be in the range of 0.02 kgf to 0.08 kgf in terms of the integral in a cross section in the rolling direction.

Each of these techniques indicates, however, that iron loss properties may deteriorate upon application of stress greater than the specified value; in particular, PTL 8 suggests the probability that "the hysteresis loss increases due to the plastic strain due to the tensile residual stress near the surface."

On the other hand, the internal stress of a steel sheet (such as tensile stress in the sheet thickness direction and compressive stress in the rolling direction) can stabilize the formation of a magnetic domain other than a primary magnetic domain magnetized in the rolling direction (an auxiliary magnetic domain), as shown in PTL 7. In other words, it is believed that higher stress provides more stable formation of an auxiliary magnetic domain even in the high magnetic field range and the eddy current loss reducing effect can be effectively achieved even in the high magnetic field range, leading to low iron loss properties, as stated later.

It is generally said that formation of an auxiliary magnetic domain contributes to segmentation of a primary magnetic domain and reduction of eddy current loss. The mechanism of this phenomenon has not been clarified exactly, it is believed that the depth of this auxiliary magnetic domain in sheet thickness direction strongly affects the eddy current loss, and a deeper auxiliary magnetic domain provides a greater eddy current loss reducing effect. A similar mechanism is discussed in, for example, *Kawasaki Steel Technical Report No.* 29 (1997) 3, pp. 153-158 (NPL 1) for a material with grooves formed therein.

Based on the above discoveries and as a result of further experiments, the inventors revealed:

(1) an eddy current loss reducing effect greater than the conventional art can be obtained by setting the depth in the sheet thickness direction of a region in a steel sheet to be 42 μm or more where a stress of as high as 150 MPa or more (the largest among tensile stress in the sheet thickness direction, compressive stress in the rolling direction, and tensile stress in the direction orthogonal to the rolling direction) forms;

(2) the aforementioned eddy current loss reducing effect is large enough to make iron loss, which is the sum of hysteresis loss and eddy current loss, extremely low even when a stress of 150 MPa or more forms; and (3) when a stress of 150 MPa or more forms, an auxiliary magnetic domain stably exists even in a high magnetic field excitation region, resulting in low iron loss properties.

In other words, the inventors found that the iron loss of the steel sheet ($W_{17/50}$) was low when a stress of as high as 150 MPa or more formed therein, and was extremely low even in a high excitation magnetic flux density range up to 1.9 T. The inventors also found a stress distribution in steel such that a stress of as high as 150 MPa or more formed over the regions, each extending 300 μm or less in the rolling direction and 42 μm or more in the sheet thickness direction, and discovered that the aforementioned effect can be obtained by forming such strain formation regions periodically at intervals of 2 mm to 10 mm or less in the rolling direction.

The inventors further discovered that using an electron beam emitted from $LaB_6$ is extremely useful for manufacturing such a steel sheet. $LaB_6$ is generally known to be advantageous for outputting a high intensity beam, and the experiments of the inventors also showed that an electron beam emitted from $LaB_6$ was a beam of extremely high energy density with a beam diameter of 0.2 mm or less (measured by slit method). Many of conventional electron beams use tungsten filament and have an advantage of being inexpensive, yet the beam diameter is approximately 0.3 mm at the just-focus position (see Table 1 below).

TABLE 1

| Electron Beam Source (Cathode Material) | Acceleration Voltage (kV) | Beam Current (mA) | WD (mm) | Pressure in Processing Chamber (Pa) | Beam Diameter (mm) |
|---|---|---|---|---|---|
| Tungsten | 40 | 15 | 525 | 0.3 | 0.32 |
| $LaB_6$ | 40 | 15 | 525 | 0.3 | 0.20 |

It is estimated here that as the aforementioned beam diameter becomes smaller, the energy density of the beam may increase, making it easier to cause a local temperature rise and expansion of the steel sheet, which is thus effective for producing large stress. In addition, even if regions with predetermined stress are applied deeply in the sheet thickness direction, those regions can be still formed with less stress expansion in the rolling direction.

Further, JP2008127632A (PTL 9) describes a technique to produce a low iron loss material with less deterioration of hysteresis loss properties due to thermal strain application by optimizing the residual stress formed in the sheet thickness direction of a steel sheet after laser irradiation to be 40 MPa or more but not greater than the yield stress.

However, the technique described in PTL 9 applies laser peening, in which irradiation is performed in water in a specially designed environment, and lacks an appropriate technological support for allowing continuous processing of coils, unavoidably resulting in increased costs.

Furthermore, a large output is necessarily used to adjust laser conditions such that the residual stress is set to be 150 MPa or more. As a result, not only is the coating on the irradiated surface of the steel sheet damaged, but also the steel substrate melts, presenting the problems of not being able to guarantee stacked steel sheets having insulation properties when built in a transformer, causing rust to form on the exposed portion of the steel substrate, and so on. To address these problems, recoating is performed in some cases, which, however, impairs the stacking factor of the iron core. On the other hand, if the residual stress, which stabilizes closure domains formed on laser irradiation portions, is as low as less than 150 MPa, the closure domain structure, which is considered as being advantageous for reducing transformer iron loss, will be collapsed, in particular, at the time of high magnetic field excitation.

Thus, given that a steel sheet is used as an iron core of a transformer, as high a residual stress as possible needs to be created in the steel sheet without damaging the coating, and further more, such a stress distribution range that will not excessively degrade the iron loss properties needs to be clearly defined.

On the assumption that the aforementioned problems could be solved by using electron beam method which would suppress damage to the coating more easily, the inventors conducted some experiments and yielded the findings below.

That is, for forming a high residual stress inside the steel sheet and for minimizing the expansion of the stress distribution that would cause a deterioration of the iron loss properties, it is important to irradiate the steel sheet with an extremely high intensity beam and it is effective to use $LaB_6$ as the cathode material for the electron beam source. The inventors also found that it is possible to suppress damage to the coating by increasing the acceleration voltage to 90 kV or more, even when the steel sheet is irradiated with a high intensity beam.

The present invention is based on the aforementioned findings.

Specifically, main features of the present invention are as follows.

1. A grain-oriented electrical steel sheet for iron cores exhibiting excellent transformer iron loss properties in an excitation range from 1.5 T to 1.9 T, linear strains having been applied to a surface of the steel sheet, the linear strains extending in a direction forming an angle of 60° to 120° with a rolling direction, wherein residual stress formation regions to which a residual stress of 150 MPa or more has been applied are formed near the linear strains, each of the residual stress formation regions extending 300 μm or less in the rolling direction and 42 μm or more in the sheet thickness direction, and wherein the linear strains are formed periodically at intervals of 2 mm to 10 mm in the rolling direction.

2. A grain-oriented electrical steel sheet for iron cores exhibiting excellent transformer iron loss properties in an excitation range from 1.5 T to 1.9 T, linear strains having been applied to a surface of the steel sheet, the linear strains extending in a direction forming an angle of 60° to 120° with a rolling direction, wherein residual stress formation regions to which a residual stress of 150 MPa or more has been applied are formed near the linear strains, each of the residual stress formation regions extending 300 μm or less in the rolling direction and 42 μm or more in the sheet thickness direction, wherein the residual stress formation regions are formed at intervals of 150 μm or more in the direction the linear strains extend, and wherein the linear strains are formed periodically at intervals of 2 mm to 10 mm in the rolling direction.

3. The grain-oriented electrical steel sheet for iron cores exhibiting excellent transformer iron loss properties in an excitation range from 1.5 T to 1.9 T according to the aspect 1 or 2, wherein the surface on which the linear strains are formed is an insulating coating not exposing a steel substrate.

4. A method of manufacturing the grain-oriented electrical steel sheet for iron cores exhibiting excellent transformer iron loss properties in an excitation range from 1.5 T to 1.9 T according to any one of the aspects 1 to 3, wherein the surface of the steel sheet is irradiated with an electron beam emitted from $LaB_6$ to form the linear strains on the surface of the steel sheet.

5. A method of manufacturing the grain-oriented electrical steel sheet for iron cores exhibiting excellent transformer iron loss properties in an excitation range from 1.5 T to 1.9 T according to any one of the aspects 1 to 3, wherein the surface of the steel sheet is irradiated with an electron beam at a voltage of 90 kV or more.

6. The method of manufacturing the grain-oriented electrical steel sheet for iron cores exhibiting excellent transformer iron loss properties in an excitation range from 1.5 T to 1.9 T according to the aspect 4, wherein the surface of the steel sheet is irradiated with the electron beam at a voltage of 90 kV or more.

Advantageous Effect of Invention

According to the present invention, it is possible to produce a transformer that exhibits low iron loss properties and high energy efficiency in a wide magnetic flux density range covering an extremely high excitation magnetic flux density range of 1.5 T to 1.9 T.

BRIEF DESCRIPTION OF DRAWINGS

The present invention will be further described below with reference to the accompanying drawings, wherein:

FIG. 3(*b*) shows the influence exerted on eddy current loss $We_{17/50}$ by the expansion in the sheet thickness direction of a region where a residual stress as high as 150 MPa or more is formed;

FIG. 4(*b*) shows the influence exerted on hysteresis loss $Wh_{17/50}$ by the expansion in the rolling direction of a region where a residual stress as high as 150 MPa or more is formed.

DESCRIPTION OF EMBODIMENTS

Figure 1:
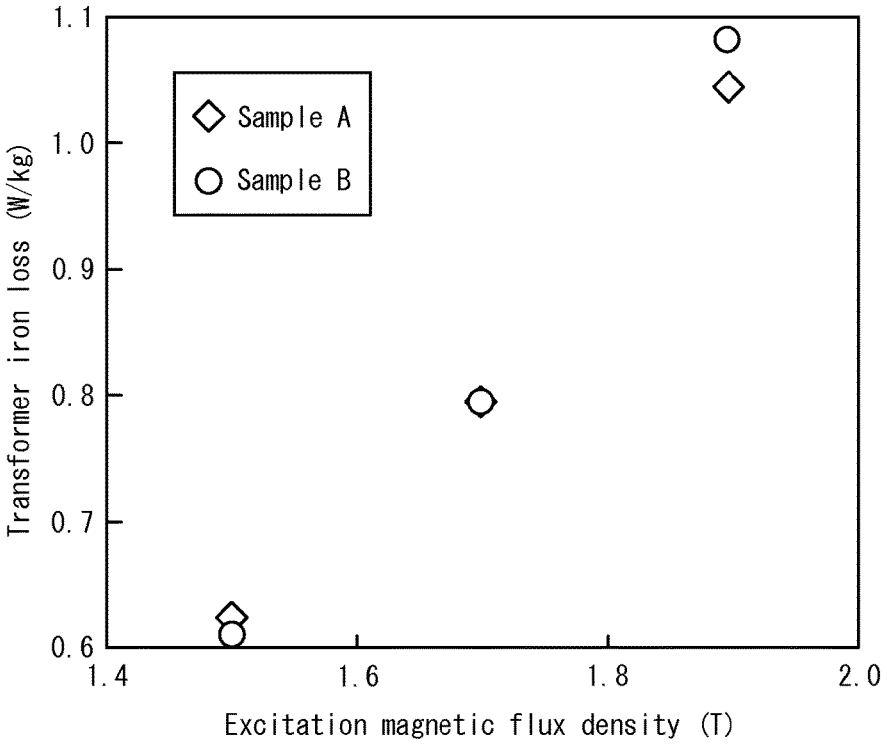
FIG. 1 shows the influence of magnetizing flux density on transformer iron loss for different samples.

The present invention will now be described in detail below. Firstly, preferred conditions for manufacturing a grain-oriented electrical steel sheet (which may also be referred to simply as the "steel sheet") for iron cores in which the present invention may be implemented will be described. In the present invention, any chemical composition that allows secondary recrystallization to proceed may be used as the chemical composition of a slab for the steel sheet. In the present invention, the chemical composition may contain appropriate amounts of Al and N in the case where an inhibitor, e.g., an AlN-based inhibitor is used, or appropriate amounts of Mn and Se and/or S in the case where a MnS/MnSe-based inhibitor is used.

To obtain an inhibitor effect, preferred contents of Al, N, S, and Se are: Al: 0.01 mass % to 0.065 mass %, N: 0.005 mass % to 0.012 mass %, S: 0.005 mass % to 0.03 mass %, and Se: 0.005 mass % to 0.03 mass %.

The present invention is also applicable to a grain-oriented electrical steel sheet having limited contents of Al, N, S and Se without using an inhibitor. In this case, the contents of Al, N, S and Se are preferably limited to Al: 100 mass ppm or less, N: 50 mass ppm or less, S: 50 mass ppm or less, and Se: 50 mass ppm or less, respectively.

Specific examples of preferred basic components and other components to be optionally added of the slab for the grain-oriented electrical steel sheet of the present invention are as follows.

C: 0.08 Mass % or Less

Carbon (C) is added for improving the texture of a hot rolled sheet. The C content is preferably 0.08 mass % or less, because excessive addition of carbon makes it difficult to reduce the C content to 50 mass ppm or less during the manufacturing process, at which point magnetic aging will not occur. Besides, it is not necessary to set a particular lower limit to the C content, yet an industrially feasible lower limit is around 0.0005 mass %.

Si: 2.0 Mass % to 8.0 Mass %

Silicon (Si) is an element that is effective for enhancing electrical resistance of the steel substrate and improving eddy current loss properties thereof. The Si content in steel is thus preferably 2.0 mass % or more. On the other hand, Si content above 8.0 mass % significantly deteriorates the flux density of the steel. Therefore, the Si content is preferably in the range of 2.0 mass % to 8.0 mass %.

Mn: 0.005 Mass % to 1.0 Mass %

Manganese (Mn) is an element that is necessary for achieving better hot workability of steel. When the content of Mn in steel is below 0.005 mass %, however, this effect is insufficient. On the other hand, when the content of Mn is above 1.0 mass %, the magnetic flux of the resulting product steel sheet worsens. Accordingly, the Mn content is preferably in the range of 0.005 mass % to 1.0 mass %.

The slab according to the present invention may further contain, for example, following elements as magnetic properties improving components in addition to the basic components described above.

At least one selected from Ni: 0.03 mass % to 1.50 mass %, Sn: 0.01 mass % to 1.50 mass %, Sb: 0.005 mass % to 1.50 mass %, Cu: 0.03 mass % to 3.0 mass %, P: 0.03 mass % to 0.50 mass %, Mo: 0.005 mass % to 0.10 mass %, and Cr: 0.03 mass % to 1.50 mass %

Nickel (Ni) is an element that is useful for improving the texture of a hot rolled sheet for better magnetic properties thereof. However, a Ni content in steel below 0.03 mass % is less effective for improving magnetic properties, while a Ni content in steel above 1.50 mass % destabilizes secondary recrystallization, resulting in deteriorated magnetic properties. Therefore, the Ni content is preferably in the range of 0.03 mass % to 1.50 mass %. In addition, Sn, Sb, Cu, P, Mo, and Cr are elements that are useful for improving magnetic properties. However, if any of these elements is contained in an amount less than its lower limit described above, it is less effective for improving the magnetic properties, whereas if contained in an amount exceeding its upper limit described above, it inhibits the growth of secondary recrystallized grains. Thus, each of these elements is preferably contained in an amount within the above-described range.

The balance other than the above-described elements includes Fe and incidental impurities that are incorporated during the manufacturing process.

Then, the slab having the aforementioned chemical composition is heated and subjected to hot rolling. However, the slab may also be subjected to hot rolling directly after casting, without being subjected to heating, or in the case of a thin slab or thinner cast steel, it may directly proceed to the subsequent step, omitting hot rolling.

Furthermore, the hot rolled sheet is optionally subjected to hot band annealing. At this time, a hot band annealing temperature is preferably in the range of 800° C. to 1100° C. If a hot band annealing temperature is lower than 800° C., there remains a band texture resulting from hot rolling, which makes it difficult to obtain a primary recrystallization texture of uniformly-sized grains and impedes the growth of secondary recrystallization. On the other hand, if a hot band annealing temperature exceeds 1100° C., the grain size after the hot band annealing coarsens too much, which makes it extremely difficult to obtain a primary recrystallization texture of uniformly-sized grains.

After the hot band annealing, the steel sheet is subjected to cold rolling once, or twice or more with intermediate annealing performed therebetween, so as to have a desired sheet thickness, followed by recrystallization annealing. Then, an annealing separator is applied to the steel sheet, which in turn is subjected to final annealing for purposes of secondary recrystallization and formation of a forsterite film.

It is effective to subject the steel sheet to flattening annealing to remove any strain caused by coil setting and the like at the ti me of the final annealing. According to the present invention, insulating coating is applied to the surface of the steel sheet before or after the flattening annealing. As used herein, "insulating coating" refers to coating that may apply tension to the steel sheet to reduce iron loss (hereinafter, referred to as tension coating). The tension coating can be implemented by, for example, an inorganic coating containing silica or a ceramic coating applied by means of physical deposition, chemical deposition and the like.

In the present invention, the grain-oriented electrical steel sheet after the above-described final annealing or tension coating is subjected to magnetic domain refining treatment by it radiating the surface of the steel sheet with an electron beam under the conditions indicated below.

Subsequently, the method for irradiation with an electron beam according to the present invention will be described in detail below.

[Conditions for Generating the Electron Beam]

Electron Beam Source Material: $LaB_6$

As mentioned earlier, $LaB_6$ is considered as being extremely advantageous for outputting a high intensity beam, and thus preferable for keeping the stress in steel within a predetermined range. In other words, an electron beam emitted from $LaB_6$ allows a region with a predetermined stress level to be formed to a sufficient depth in the sheet thickness direction, but to expand to a limited range in the rolling direction.

Acceleration Voltage: 40 kV to 300 kV

A higher acceleration voltage is more advantageous as being less susceptible to the scattering caused by a residual gas remaining in the processing chamber. However, an excessively high acceleration voltage weakens the beam current, which is necessary for magnetic domain refining, presenting the problems of worsened stable controllability, an in crease in size of members required for providing shielding from x-rays originating from the steel sheet, and increased costs.

Therefore, the acceleration voltage is preferably in the range of around 40 kV to around 300 kV.

In addition, the surface on which linear strains are formed is preferably insulating coating not exposing a steel substrate. To suppress damage to the coating of the steel sheet, the acceleration voltage needs to be 90 kV or more.

Table 2 shows the results of examining damage to the coating and residual stress at electron beam irradiation portions of grain-oriented electrical steel sheets when irradiated with an electron beam emitted from $LaB_6$ at an output of 0.6 kW and having a beam diameter (beam half-width) of 0.2 mm for magnetic domain refining, respectively. The beam diameter was adjusted depending on the working distance and the focusing current. Regarding the damage to the coating, ratings are: "N/O" for not observed and "O" for observed. Regarding the residual stress (as used herein, reference to simply "stress" means residual stress), an "Applicable" rating is given to a case where each of the regions to which a residual stress of 150 MPa or more has been applied extends to a depth of 42 μm or more in the sheet thickness direction and to a distance of 300 μm or less in the rolling direction. The results showed that in the case of forming a stress of 150 MPa, damage to the coating may be suppressed if the acceleration voltage is set to be 90 kV or more.

TABLE 2

| Acceleration Voltage (kV) | Current (mA) | Damage to Coating | Residual Stress |
|---|---|---|---|
| 40 | 15 | O | Applicable |
| 60 | 10 | O | Applicable |
| 90 | 6.7 | N/O | Applicable |
| 120 | 5 | N/O | Applicable |

Line Spacing: 2 mm to 10 mm

Each steel sheet is irradiated with an electron beam in a linear manner or in a dot-sequence manner, from one widthwise edge of the steel sheet to the other widthwise edge. The irradiation is repeated with a constant interval between repetitions in the rolling direction. This interval (line spacing) needs to be 2 mm to 10 mm. The reason is as follows. If the line spacing is narrower than this, excessively large strain regions are formed in steel, which may cause iron loss (hysteresis loss) properties to deteriorate. On the other hand, if the line spacing is excessively large, a magnetic domain refining effect is insufficient, and the iron loss properties will not improve.

Line Angle: 60° to 120°

In the aforementioned beam irradiation performed in a linear manner from one widthwise edge of a steel sheet to the other, an angle that the rolling direction of the steel sheet forms with the direction from the start point to the end point of the linear irradiation is referred to herein as a line angle. This line angle is set to be 60° to 120° with respect to the rolling direction. If the line angle deviates from this range, excessively large beam irradiation regions are formed in the steel sheet, which may cause hysteresis loss properties to deteriorate.

As used herein, "linear" refers to not only a straight line but also a dotted line and a discontinuous line, where the aforementioned line angle represents the angle that the straight line connecting the start and end points of a dotted line or a discontinuous line forms with the rolling direction. In this case, when electron beam irradiation is performed in a dot-sequence manner, the residual stress in steel forms periodically in correspondence with the dot sequences, except the case where the dot-sequential irradiation is performed at extremely small intervals. As described in the examples below, extremely good iron loss properties (an extremely low ratio of $W_{19/50}$ to $W_{17/50}$) were obtained at a high magnetic flux density when setting the intervals, in the direction linear strains extend, among those regions where a residual stress of 150 MPa or more forms to 0.15 mm (150 μm) or more. Presumably, the reason is that the dot-sequential electron beam irradiation contributed to minimization of the volume of the residual stress formation regions.

On the other hand, in the case of dotted or discontinuous irradiation, those regions where a residual stress of 150 MPa or more forms are preferably formed at intervals of 0.8 mm (800 μm) or less between dots arranged linearly or between continuous lines. The reason is that excessively small amounts of irradiation regions (stress formation regions) may result in a poor eddy current loss improving effect.

Pressure in Processing Chamber: 3 Pa or Less

If the pressure in the processing chamber is excessively high, electrons generated from the electron gun scatter, and the electron energy that provides the heat effect to the steel substrate reduces. As a result, magnetic domain refining is not sufficiently achieved in the steel sheet, and iron loss properties might not improve. Therefore, according to the present invention, the pressure in the processing chamber is preferably set to be 3 Pa or less. It is not necessary to set a particular lower limit on the pressure.

Focusing Current

It is preferred that the focusing current is adjusted in advance so that the beam power density is uniform in the widthwise direction when irradiating by deflecting an electron beam in the widthwise direction.

[Stress Distribution in Steel]

Stress Direction

The steel sheet according to the present invention has linear strains applied to a surface thereof. The linear strains extend in a direction forming an angle of 60° to 120° with the rolling direction. Stress is present in the steel sheet near the linear strains, and the stress is formed by compressive stress in the rolling direction, tensile stress in the sheet thickness direction, or tensile stress in the direction orthogonal to the rolling direction.

As used herein, the phrase "near the linear strains" refers to, as mentioned above, those regions where the stress formed by the linear strains is present, and more specifically, to those regions formed within 500 μm or less from each electron beam irradiation region.

Generally, magnetoelastic energy is stable in the presence of compressive stress when the magnetization direction forms an angle of 90° with the direction of compression, and in the presence of tensile stress when the magnetization direction is oriented along the direction of tension.

Therefore, upon formation of the aforementioned stress, the primary magnetic domain, which was originally oriented along the rolling direction, is destabilized, leading to formation of an auxiliary magnetic domain oriented in another direction.

Maximum Stress in Steel: 150 MPa or More

As the aforementioned stress (compressive stress in the rolling direction, tensile stress in the sheet thickness direction, or tensile stress in the direction orthogonal to the rolling direction) increases, the aforementioned auxiliary magnetic domain remains stable in a higher excitation range.

Figure 2A:
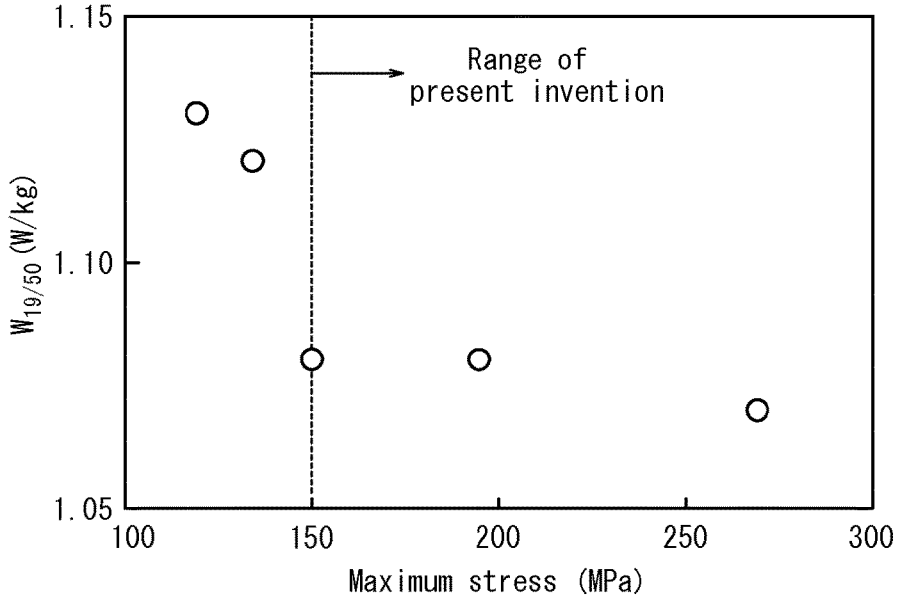
FIG. 2(*a*) shows the influence of the maximum stress (the largest among tensile stress in the sheet thickness direction, compressive stress in the rolling direction, and tensile stress in the direction orthogonal to the rolling direction) on $W_{19/50}$, and FIG. 2 (*b*) shows the influence of the maximum stress on the ratio of $W_{19/50}$ to $W_{17/50}$.
Figure 2B:
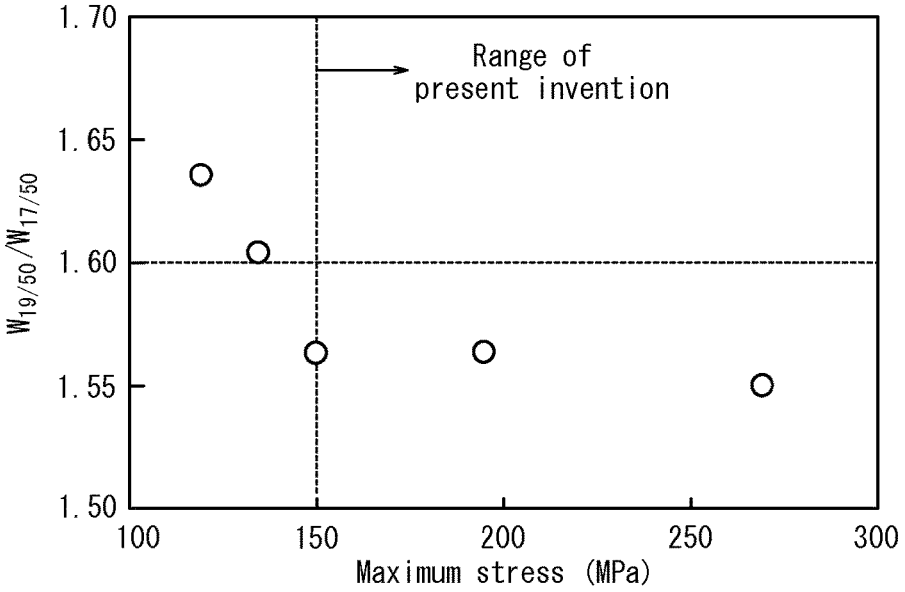

FIG. 2(*a*) shows the influence of the maximum value of the aforementioned stress (maximum residual stress) on $W_{19/50}$, and FIG. 2(*b*) shows the influence of the maximum stress on the ratio of $W_{19/50}$ to $W_{17/50}$.

Where the maximum stress is 150 MPa or more, $W_{19/50}$ of less than 1.12 W/kg is obtained as shown in FIG. 2(*a*) and the ratio of $W_{19/50}$ to $W_{17/50}$ is equal to 1.60 or less as shown in FIG. 2(*b*). It is noted here that all of the shown results are comparisons among steel sheets having comparable magnetic properties after being subjected to magnetic domain refining treatment, with $W_{15/50}$ of 0.51 W/kg and $W_{17/50}$ in the range of 0.69 W/kg to 0.70 W/kg. It was also found that the regions where a residual stress of 150 MPa or more formed expanded by 42 μm to 48 μm in the sheet thickness direction of the steel sheet, and by 200 μm to 220 μm in the widthwise direction of the steel sheet. Note that the aforementioned stress expansion was measured by the method stated below.

The direction of the maximum stress was oriented principally along the sheet thickness direction, where the maximum stress in the rolling direction was determined to be 30 MPa or more.

In addition, the upper limit of the maximum stress in steel is not particularly limited, yet is practically around 600 MPa.

Regions where a Residual Stress of 150 MPa or More Forms: 42 μm or More in the Sheet Thickness Direction Expansion of an auxiliary magnetic domain in the sheet thickness direction presumably affects magnetic domain refining and reduction of eddy current loss.

Figure 3A:
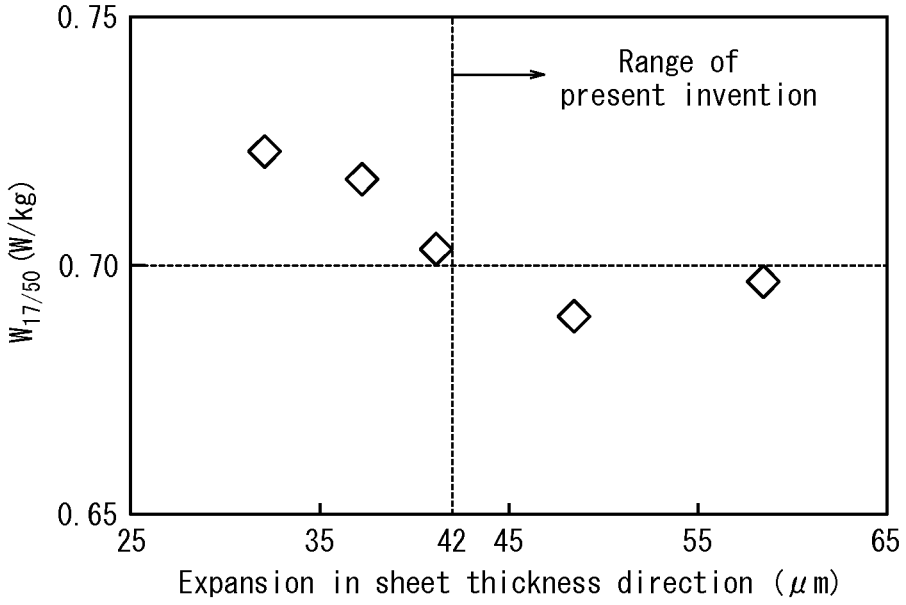
FIG. 3 (*a*) shows the influence exerted on $W_{17/50}$ by the expansion in the sheet thickness direction of a region where a residual stress as high as 150 MPa or more is formed.
Figure 3B:
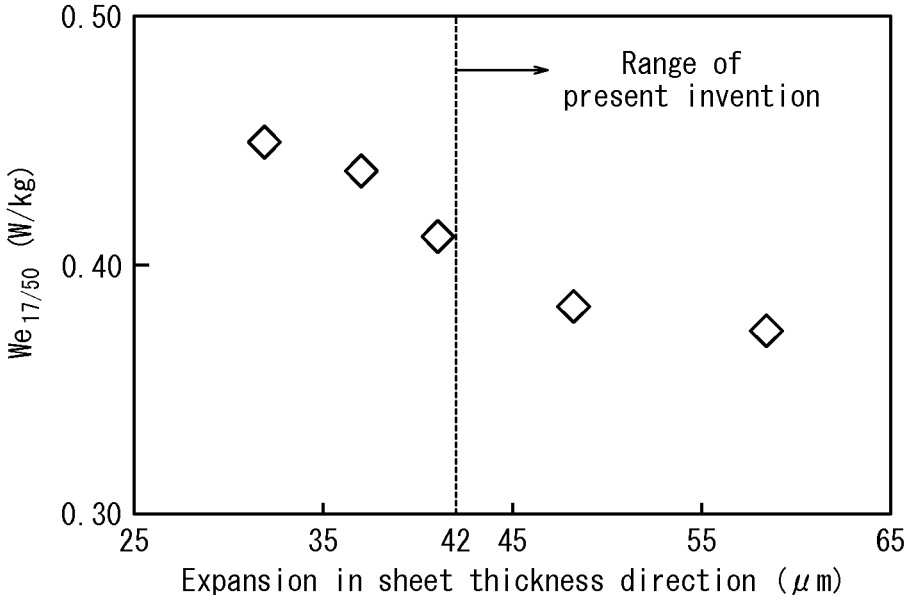

FIG. 3(*a*) shows the influence exerted on $W_{17/50}$ by the expansion of regions where a stress of as high as 150 MPa or more forms in the sheet thickness direction, and FIG. 3(*b*) shows the influence exerted on eddy current loss $We_{17/50}$ by the expansion of regions where a stress of 150 MPa or more forms in the sheet thickness direction.

It was found that as the regions where a stress of 150 MPa or more formed expanded in the sheet thickness direction, the eddy current loss and the iron loss decreased. In particular, where regions where a stress of as high as 150 MPa or more formed expanded in the sheet thickness direction by 42 μm or more, an excellent iron loss property as low as 0.70 W/kg or less was obtained. It is noted here that all of the shown results are comparisons among steel sheets having comparable magnetic properties after being subjected to magnetic domain refining treatment, where the maximum stress in steel was determined to be 255 MPa to 300 MPa. It was also found that the regions where a stress of 150 MPa or more formed expanded in the widthwise direction by 180 μm to 225 μm.

Note that that the upper limit of the expansion range of regions where a residual stress of 150 MPa or more forms in the sheet thickness direction is not particularly limited, yet is practically around 100 μm.

Regions where a Residual Stress of 150 MPa or More Forms: 300 μm or Less in the Rolling Direction It is believed that even when residual stress formation regions so expanded in the rolling direction of the steel sheet as to produce an additional auxiliary magnetic domain, there will be little change in the amount of free magnetic poles formed at the boundary between the primary magnetic domain and the auxiliary magnetic domain. It is thus considered that the formation of such an auxiliary magnetic domain will not greatly affect magnetic domain refining. On the other hand, excessive expansion of the residual stress formation regions will result in higher hysteresis loss because of the presence of strain in the residual stress formation regions. Therefore, the expansion of regions where a residual stress of 150 MPa or more forms is limited to 300 μm or less in the rolling direction.

Note that that the lower limit of the expansion range of regions where a residual stress of 150 MPa or more forms in the rolling direction is not particularly limited, yet is practically around 20 μm.

Figure 4A:
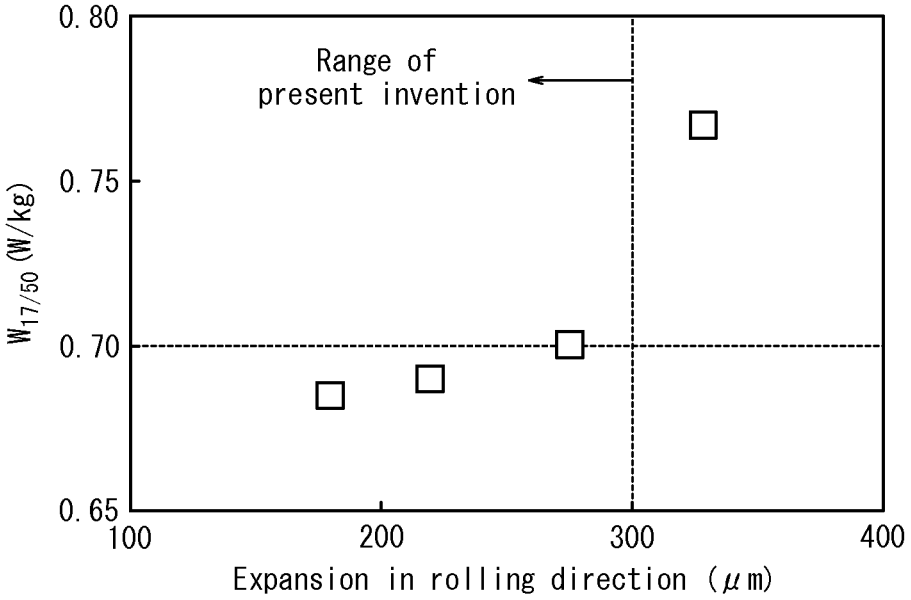
FIG. 4(*a*) shows the influence exerted on $W_{17/50}$ by the expansion in the rolling direction of a region where a residual stress as high as 150 MPa or more is formed.
Figure 4B:
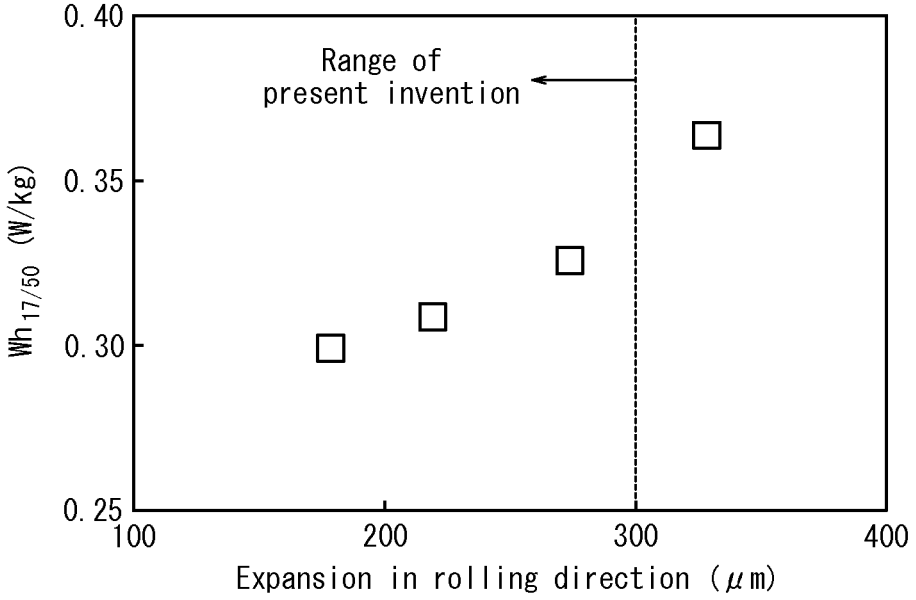

FIG. 4(*a*) shows the influence exerted on $W_{17/50}$ by the expansion of regions where a stress of 150 MPa or more forms in the rolling direction, and FIG. 4(*b*) shows the influence exerted on hysteresis loss $Wh_{17/50}$ by the expansion of regions where a stress of 150 MPa or more forms in the rolling direction. It can be seen from the figures that as the regions where a stress of 150 MPa or more formed expanded in the rolling direction of the steel sheet, the hysteresis loss and the iron loss increased. In particular, where the regions expanded by more than 300 μm in the rolling direction, hysteresis loss excessively increased to 0.35 W/kg or more and iron loss exceeded 0.70 W/kg. It is noted here that all of the shown results are comparisons among steel sheets having comparable magnetic properties after being subjected to magnetic domain refining treatment, where the maximum stress was determined to be 270 MPa to 300 MPa. In addition, the stress expansion in the sheet thickness direction was determined to be 45 μm to 50 μm.

[Measurement Method for Stress Distribution]

In the present invention, the stress distribution of a steel sheet was determined from the strain distribution measured by the EBSD-wilkinson method using CrossCourt Ver. 3.0 (produced by BLG Productions, Bristol) and by using an elastic modulus of 3% Si—Fe. The stress distribution, however, may be determined by x-ray analysis. When x-ray analysis or the like is used, however, a collimator with a small diameter is preferably used for improved measurement resolution.

In the present invention, measurements were made in a cross-section of each steel sheet taken along the rolling direction, over 600 μm or more in the rolling direction, at the pitch of 5 μm across the entire thickness of the steel sheet. Note that an unstrained reference point, which is necessary for strain measurement, was positioned at the edge of the field of view for measurement in such a way that the strain distribution was symmetric about the center of the field of view.

In the present invention, other than the above-described steps and manufacturing conditions, a conventionally known method for manufacturing a grain-oriented electrical steel sheet subjected to magnetic domain refining treatment using an electron beam may be adopted.

EXAMPLES

Steel slabs, each containing, by mass %, C: 0.05%, Si: 3.1%, Mn: 0.12%, Ni: 0.01%, O: 0.003%, N: 0.007%, Al: 0.025%, Se: 0.02%, S: 0.003%, and the balance including Fe and incidental impurities, were prepared by continuous casting, heated to 1430° C., subjected to hot rolling to obtain a hot rolled sheet having a sheet thickness of 1.6 mm, and then subjected to hot band annealing at 1000° C. for 10 seconds. Subsequently, each steel sheet was subjected to cold rolling to have an intermediate sheet thickness of 0.55 mm, and then to intermediate annealing under the following conditions: degree of oxidation $PH_2O/PH_2$=0.37, temperature=1100° C., and duration=100 seconds. Subsequently, each steel sheet was subjected to pickling with hydrochloric acid to remove subscales from the surfaces thereof, followed by cold rolling again to be finished to a cold-rolled steel sheet having a sheet thickness of 0.23 mm.

Then, each cold-rolled steel sheet was subjected to decarburization annealing where it was retained at a degree of oxidation $PH_2O/PH_2$=0.45 and a soaking temperature of 850° C. for 150 seconds. Then, an annealing separator mainly composed of MgO was applied to each steel sheet. Thereafter, each steel sheet was subjected to final annealing for the purposes of secondary recrystallization and purification under the conditions of 1180° C. and 60 hours.

A tension coating composed of 50% of colloidal silica and magnesium phosphate was then applied to each steel sheet, and the iron loss was measured. The iron loss $W_{17/50}$ was in the range of 0.83 W/kg to 0.86 W/kg. Subsequently, magnetic domain refining treatment was performed by irradiating with an electron beam under the irradiation conditions listed in Table 3, with the line angle of 90° and the pressure in the processing chamber of 0.1 Pa, to measure the iron loss.

Table 4 shows the measurement results.

TABLE 4

| Test No. | I $W_{15/50}$ (W/kg) | II $W_{17/50}$ (W/kg) | III $W_{19/50}$ (W/kg) | III/II | Damage to Coating | Remarks |
|---|---|---|---|---|---|---|
| 1 | 0.51 | 0.69 | 1.08 | 1.57 | N/O | Inventive Example |
| 2 | 0.51 | 0.69 | 1.08 | 1.57 | N/O | Inventive Example |
| 3 | 0.51 | 0.69 | 1.07 | 1.55 | N/O | Inventive Example |
| 4 | 0.52 | 0.70 | 1.11 | 1.58 | N/O | Inventive Example |
| 5 | 0.51 | 0.70 | 1.07 | 1.54 | N/O | Inventive Example |
| 6 | 0.51 | 0.68 | 1.05 | 1.54 | N/O | Inventive Example |
| 7 | 0.52 | 0.70 | 1.11 | 1.58 | N/O | Inventive Example |
| 8 | 0.51 | 0.69 | 1.09 | 1.57 | N/O | Inventive Example |
| 9 | 0.58 | 0.75 | 1.14 | 1.52 | N/O | Comparative Example |
| 10 | 0.54 | 0.73 | 1.17 | 1.61 | N/O | Comparative Example |
| 11 | 0.54 | 0.74 | 1.17 | 1.58 | N/O | Comparative Example |
| 12 | 0.53 | 0.74 | 1.18 | 1.59 | N/O | Comparative Example |
| 13 | 0.51 | 0.68 | 1.04 | 1.53 | N/O | Inventive Example |
| 14 | 0.50 | 0.68 | 1.03 | 1.51 | N/O | Inventive Example |
| 15 | 0.51 | 0.70 | 1.11 | 1.58 | N/O | Inventive Example |
| 16 | 0.54 | 0.73 | 1.14 | 1.56 | O | Comparative Example |
| 17 | 0.51 | 0.69 | 1.09 | 1.57 | O | Comparative Example |
| 18 | 0.54 | 0.72 | 1.21 | 1.68 | O | Comparative Example |

It can be seen from Tables 3 and 4 that a steel sheet that exhibits extremely low iron loss even in a high excitation range can be obtained with $W_{15/50}$ of 0.52 W/kg or less, $W_{17/50}$ of 0.70 W/kg or less, and $W_{19/50}$ of 1.11 W/kg or less,

TABLE 3

| Test No. | Irradiation Means | Electron Beam Source (Cathode Material) | Acceleration Voltage (kV) | Electron Beam: Line Space (mm) | Electron Beam: Diameter (μm) | Electron Beam: Current (mA) | Electron Beam: Scanning Rate (m/s) | Maximum Stress (MPa) | Stress of 150 MPa or more: Intervals between Residual Stress Formation Regions (mm) | Stress of 150 MPa or more: Expansion in Sheet Thickness Direction (μm) | Stress of 150 MPa or more: Expansion in Rolling Direction (μm) | Remarks |
|---|---|---|---|---|---|---|---|---|---|---|---|---|
| 1 | Electron Beam | $LaB_6$ | 100 | 4 | 220 | 0.75 | 5 | 150 | Continuous | 42 | 210 | Inventive Example |
| 2 | Electron Beam | $LaB_6$ | 100 | 4 | 220 | 1.6 | 10 | 195 | Continuous | 45 | 215 | Inventive Example |
| 3 | Electron Beam | $LaB_6$ | 100 | 4 | 220 | 5 | 30 | 270 | Continuous | 48 | 220 | Inventive Example |
| 4 | Electron Beam | $LaB_6$ | 90 | 4 | 200 | 5 | 30 | 255 | Continuous | 42 | 200 | Inventive Example |
| 5 | Electron Beam | $LaB_6$ | 110 | 4 | 210 | 9 | 60 | 300 | Continuous | 58 | 225 | Inventive Example |
| 6 | Electron Beam | $LaB_6$ | 110 | 4 | 180 | 4 | 30 | 270 | Continuous | 50 | 180 | Inventive Example |
| 7 | Electron Beam | $LaB_6$ | 110 | 4 | 270 | 12 | 60 | 300 | Continuous | 45 | 275 | Inventive Example |
| 8 | Electron Beam | $LaB_6$ | 110 | 4 | 260 | 16 | 80 | 310 | Continuous | 59 | 250 | Inventive Example |
| 9 | Electron Beam | $LaB_6$ | 110 | 1.5 | 180 | 6.5 | 40 | 350 | Continuous | 61 | 250 | Comparative Example |
| 10 | Electron Beam | $LaB_6$ | 110 | 12 | 180 | 6.5 | 40 | 350 | Continuous | 61 | 250 | Comparative Example |
| 11 | Electron Beam | Tungsten | 175 | 4 | 280 | 6 | 40 | 270 | Continuous | 55 | 310 | Comparative Example |
| 12 | Electron Beam | Tungsten | 110 | 4 | 300 | 10 | 40 | 240 | Continuous | 50 | 305 | Comparative Example |
| 13 | Electron Beam | $LaB_6$ | 110 | 4 | 190 | 4.5 | 30 | 325 | 0.15 | 60 | 215 | Inventive Example |
| 14 | Electron Beam | $LaB_6$ | 150 | 4 | 220 | 5.5 | 40 | 350 | 0.3 | 64 | 225 | Inventive Example |
| 15 | Electron Beam | $LaB_6$ | 60 | 4 | 280 | 10 | 40 | 155 | Continuous | 43 | 265 | Inventive Example |
| 16 | Electron Beam | $LaB_6$ | 70 | 4 | 260 | 18 | 60 | 255 | 0.4 | 52 | 295 | Comparative Example |
| 17 | Laser | — | — | 4 | 120 | — | 5 | 265 | Continuous | 45 | 175 | Comparative Example |
| 18 | Laser | — | — | 4 | 160 | — | 30 | 190 | Continuous | 32 | 200 | Comparative Example |

where electron beam irradiation is performed by using $LaB_6$ in such a way that such residual stress formation regions are provided as to satisfy the conditions specified in the present invention.

The invention claimed is:

1. A grain-oriented electrical steel sheet for iron cores, the steel sheet comprising:

linear strain regions on a surface of the steel sheet, the linear strain regions each extending in a direction forming an angle of 60° to 120° with a rolling direction, and residual stress formation regions having a residual stress of 150 MPa or more, the residual stress formation regions being located near the linear strain regions, each of the residual stress formation regions extending 300 μm or less in the rolling direction and 42 μm or more in a sheet thickness direction, wherein the linear strain regions are formed periodically at intervals of 2 mm to 10 mm in the rolling direction.

2. A grain-oriented electrical steel sheet for iron cores, the steel sheet comprising:

linear strain regions on a surface of the steel sheet, the linear strain regions each extending in a direction forming an angle of 60° to 120° with a rolling direction, and residual stress formation regions having a residual stress of 150 MPa or more, the residual stress formation regions being located near the linear strain regions, each of the residual stress formation regions extending 300 μm or less in the rolling direction and 42 μm or more in the sheet thickness direction, wherein the residual stress formation regions are formed at intervals of 150 μm or more in the direction that the linear strain regions extend, and wherein the linear strain regions are formed periodically at intervals of 2 mm to 10 mm in the rolling direction.

3. The grain-oriented electrical steel sheet according to claim 1, wherein the surface on which the linear strain regions are formed is an insulating coating that does not expose a steel substrate.

4. The grain-oriented electrical steel sheet according to claim 2, wherein the surface on which the linear strain regions are formed is an insulating coating that does not expose a steel substrate.

5. A method of manufacturing the grain-oriented electrical steel sheet according to claim 1, wherein the surface of the steel sheet is irradiated with an electron beam emitted from $LaB_6$ to form the linear strain regions on the surface of the steel sheet.

6. A method of manufacturing the grain-oriented electrical steel sheet according to claim 2, wherein the surface of the steel sheet is irradiated with an electron beam emitted from $LaB_6$ to form the linear strain regions on the surface of the steel sheet.

7. A method of manufacturing the grain-oriented electrical steel sheet according to claim 3, wherein the surface of the steel sheet is irradiated with an electron beam emitted from $LaB_6$ to form the linear strain regions on the surface of the steel sheet.

8. A method of manufacturing the grain-oriented electrical steel sheet according to claim 4, wherein the surface of the steel sheet is irradiated with an electron beam emitted from $LaB_6$ to form the linear strain regions on the surface of the steel sheet.

9. A method of manufacturing the grain-oriented electrical steel sheet according to claim 1, wherein the surface of the steel sheet is irradiated with an electron beam at a voltage of 90 kV or more.

10. A method of manufacturing the grain-oriented electrical steel sheet according to claim 2, wherein the surface of the steel sheet is irradiated with an electron beam at a voltage of 90 kV or more.

11. A method of manufacturing the grain-oriented electrical steel sheet according to claim 3, wherein the surface of the steel sheet is irradiated with an electron beam at a voltage of 90 kV or more.

12. A method of manufacturing the grain-oriented electrical steel sheet according to claim 4, wherein the surface of the steel sheet is irradiated with an electron beam at a voltage of 90 kV or more.

13. The method according to claim 5, wherein the surface of the steel sheet is irradiated with the electron beam at a voltage of 90 kV or more.

14. The method according to claim 6, wherein the surface of the steel sheet is irradiated with the electron beam at a voltage of 90 kV or more.

15. The method according to claim 7, wherein the surface of the steel sheet is irradiated with the electron beam at a voltage of 90 kV or more.

16. The method according to claim 8, wherein the surface of the steel sheet is irradiated with the electron beam at a voltage of 90 kV or more.

* * * * *